United States Patent [19]

Robinson

[11] Patent Number: 4,602,481

[45] Date of Patent: Jul. 29, 1986

[54] FLUID ACTUATOR FOR BINARY SELECTION OF OUTPUT FORCE

[75] Inventor: Curtiss W. Robinson, Seattle, Wash.

[73] Assignee: The Boeing Company, Seattle, Wash.

[21] Appl. No.: 535,980

[22] Filed: Sep. 26, 1983 (Under 37 CFR 1.47)

[51] Int. Cl.[4] ..... F15B 7/00

[52] U.S. Cl. ..... 60/581; 91/519; 92/52; 92/108; 92/113; 92/152

[58] Field of Search ..... 91/519; 60/581, 567; 92/152, 52, 108, 113

[56] References Cited

U.S. PATENT DOCUMENTS

| | | | |
|---|---|---|---|
| 1,253,718 | 1/1918 | Peterson . | |
| 2,605,751 | 8/1952 | Perry et al. . | |
| 2,916,205 | 12/1959 | Litz | 235/61 |
| 3,068,841 | 12/1962 | Robbins | 91/519 |
| 3,075,473 | 1/1963 | Finley . | |
| 3,114,297 | 12/1963 | Gizeski . | |
| 3,128,598 | 4/1964 | Gordon | 92/152 |
| 3,131,547 | 5/1964 | Collins | 92/152 |
| 3,465,648 | 9/1969 | Conklin, Jr. | 92/152 |
| 3,473,634 | 10/1969 | Strifler | 60/581 |
| 3,481,251 | 12/1969 | Shook | 92/152 |
| 4,024,794 | 5/1977 | Grubb | 91/189 |
| 4,248,046 | 2/1981 | Fornell | 60/567 |

OTHER PUBLICATIONS

Hydraulic System Analysis, by George R. Keller, published 1969, pp. 121–136.

*Primary Examiner*—Abraham Hershkovitz
*Attorney, Agent, or Firm*—Delbert J. Barnard

[57] ABSTRACT

The actuator (12) comprises three main parts, an outer casing (20), a movable piston (28) and a fixed piston (36). A stepped outer portion (50, 52, 54) of the movable piston (28) cooperates with a stepped cavity (40, 42, 44) in the casing (20) to define a plurality of concentric, variable diameter fluid chambers (1, 2, 3) bounded at their ends by radial surfaces on the movable piston (20) and within the casing cavity. The movable piston (20) and the fixed piston (36) define a plurality of axially spaced apart variable diameter fluid chambers (1', 2', 3') which are bound on their ends by radial surfaces on the fixed piston (36) and radial surfaces within the cavity formed in the movable piston (20). One set of the chambers (1, 2, 3) is connected to supply pressure ($P_S$) and the second set of chambers (1', 2', 3') is connected to return pressure ($P_R$). Seal receiving grooves are formed in outer surface portions of the fixed and movable pistons (28, 36). Seal rings ($S_R$) within these grooves seal against mating internal surfaces of the stepped cavities.

17 Claims, 3 Drawing Figures

FLUID ACTUATOR FOR BINARY SELECTION OF OUTPUT FORCE

This invention relates to an adjustable force-producing hydraulic actuator, and in particular to the provision of such an actuator characterized by a concentric actuator array which is very compact with minimum parts count and in which external leakage paths are kept to an absolute minimum and the output force vectors are colinear.

Certain fluid control systems can benefit from the use of an actuator which is capable of selecting an output force level which is proportional to the sum of a group of weighted binary bits. An example of such use would employ such an actuator as a bungee mounted so as to balance out the aerodynamic moments on an aircraft surface. The use of a bungee actuator from which force could be adjusted in binary increments would simplify the implimentation of such a bungee counterbalance system.

Reference is made to my copending application Ser. No. 536,040, filed Sept. 26, 1983, and entitled Aircraft Control Surface Actuation And Counterbalancing. That application relates to the concept of using a first hydraulic device, termed a "bungee", in a passive mode to resist the steady-state component of the aerodynamic or gravity load acting on an aircraft control surface, and a small servoactuator of a conventional type in an active mode for positioning the control surface. In accordance with a basic aspect of that invention, a counterbalancing hydraulic actuator is connected between a frame portion of the aircraft and a flight control surface and is oriented to impose a counterbalancing torque on the flight control surface acting in opposition to the torque imposed by the aerodynamic load. One embodiment of that invention utilizes a variable force hydraulic actuator to perform the counterbalancing function. The present invention relates to the provision of a new and unique binary force-producing hydraulic actuator which has particular utility as a counterbalancing bungee, in the manner disclosed in the aforementioned application Ser. No. 536,040, and other uses as well. Accordingly, a principal object of the present invention is to provide a unique and improved construction of a plural stage actuator.

Plural stage actuators and binary weighted actuators are not new. Examples of these are disclosed in chapter 9 of "Hydraulic System Analysis", by George R. Keller, first published in 1969 by the editors of Hydraulics & Pneumatics Magazine (Library of Congress catalog card No. 78-52991), and by the following United States patents:

U.S. Pat. No. 1,253,718, granted Jan. 15, 1918, to George A. Peterson; U.S. Pat. No. 2,605,751, granted Aug. 5, 1952, to Richard D. Perry and Ross H. Baumgardner; U.S. Pat. No. 2,916,205, granted Dec. 8, 1959, to Frank A. Litz; U.S. Pat. No. 3,075,473, granted Jan. 29, 1963, to Charles M. Finley; U.S. Pat. No. 3,114,297, granted Dec. 17, 1963 to Terrence Gizeski; U.S. Pat. No. 4,024,794, granted May 24, 1977, to Daniel B. Grubb and U.S. Pat. No. 4,248,046, granted Feb. 3, 1981, to Robert M. Fornell.

U.S. Pat. No. 2,916,205 is of particular interest. It discloses a binary force-producing actuator with colinear segments and an equivalent group of parallel actuators having areas related as a binary sequence. The patent does not disclose how to construct and assemble an actuator in which the segments are colinear, but rather presents the concept schematically.

An object of the present invention is to provide a unique actuator having plural piston areas related as a binary sequence characterized by a construction which makes it very compact with minimum parts count.

Another object of the invention is to provide such an actuator in which external leakage paths are kept to an absolute minimum in the concentric actuator array.

A further object of the present invention is to provide a fluid actuator for binary selection of output force which is controllable by simple solenoid driven poppets or ball valves.

Yet another aspect of the invention is to provide such an actuator constructed such that control valves may be mounted on the actuator body minimizing plumbing complexity.

The binary actuator of the present invention is basically characterized by a three-piece construction. Its three major pieces are (1) an elongated casing having a stepped inner cavity, (2) a movable piston in the casing cavity having a stepped outer surface and a stepped inner piston cavity, and (3) a stepped fixed piston in the piston cavity. The outer steps on the movable piston are sealed against mating cylindrical surfaces forming the casing cavity. In like manner, the steps on the fixed piston are sealed against mating cylindrical surfaces of the inner piston cavity.

Further advantages of the invention may be brought out in the following part of the specification wherein small details have been described for the competence of disclosure, without intending to limit the scope of the invention which is to be determined by the appended claims.

Referring to the accompanying drawings, which show an embodiment of the invention for illustrative purpose:

Figure 1:
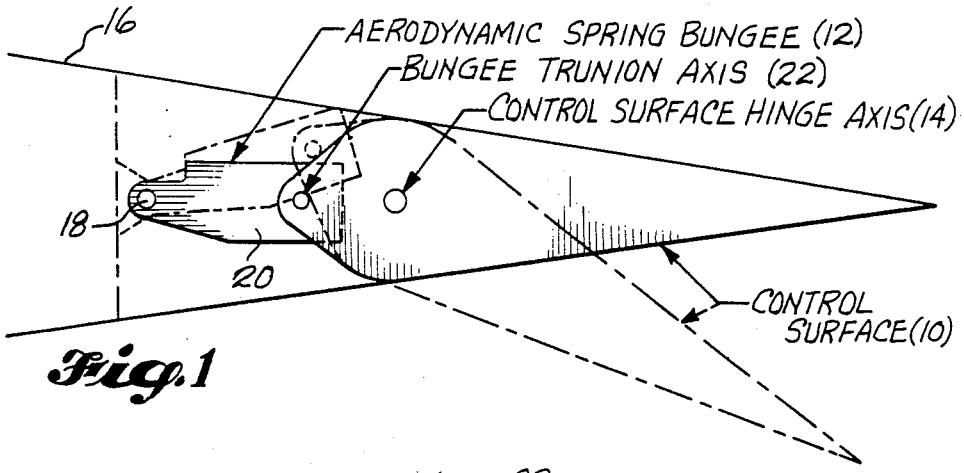
FIG. 1 is a concept view of a bungee counterbalance system incorporating a variable force output bungee.

Referring now to FIG. 1, the control surface 10 and the bungee 12 are shown in two positions. When the control surface 10 is in its neutral or trim position, the force produced by the bungee 12 is directed through the control surface hinge axis 14, i.e. there is no torque arm. Hence, although bungee 12 is producing a force, such force is not producing a rotational effect on the control surface 10.

The rod of actuator 12 is pivotally mounted to a fixed portion of the forward wing structure 16, for pivotal movement about an axis 18. The bungee casing 20 is pivotally connected to the control surface 10 for pivotal movement about an axis 22 which is offset from the control hinge axis 14. Pivot location 22 is located between axes 18 and 14 and, as previously mentioned, when the control surface 10 is in its trim position it is in alignment with the hinge axis 14.

Figure 2:
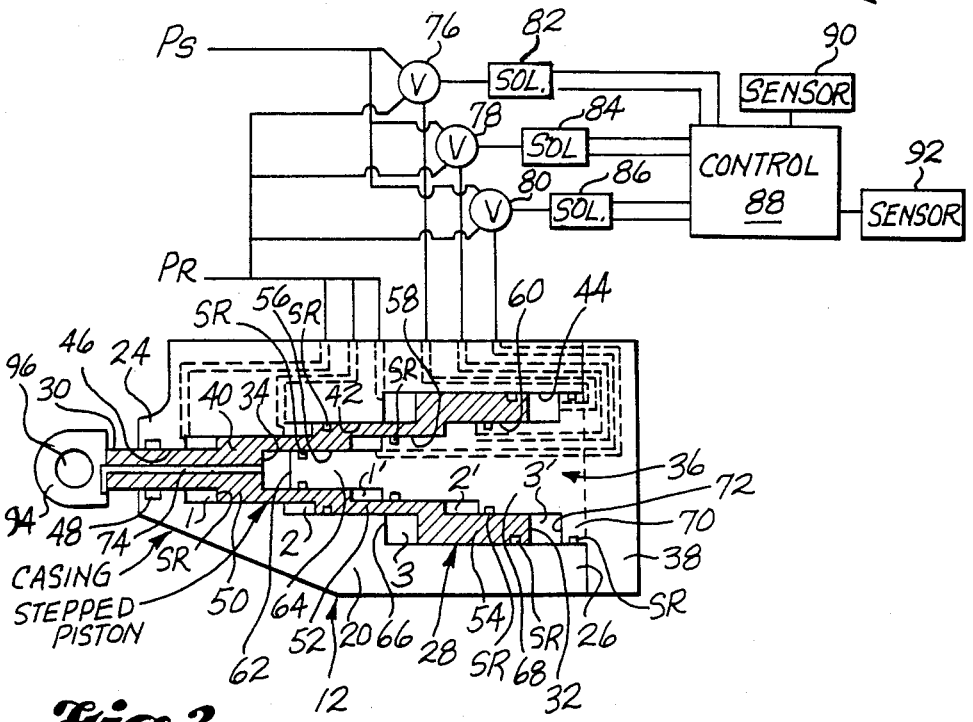
FIG. 2 is an enlarged scale longitudinal sectional view of the variable force output bungee or actuator of the present invention and a schematic showing of a basic control system.

Referring to FIG. 2, the actuator 12 comprises an elongated casing 20 having a first end 24, a second end 26 and an inner casing cavity. The casing cavity has an access opening at the second end of the casing.

A movable piston 28 is located in the casing cavity. Piston 28 includes a rod end, including a piston rod 30, and an opposite end including a radial end surface 32. Movable piston 28 is also formed to include an inner piston cavity having an inner end wall 34. Access into the cavity is provided from the second end of the piston 28. A fixed piston 36 projects into the piston cavity. Fixed piston 36 includes an outer head portion 38 by which it is attached to the casing 20.

The casing cavity has a plurality of cylinder sections which progressively increase in diameter from the first end of the casing to the second end of the casing. The illustrated embodiment comprises three cylinder sections 40, 42, 44. An axial passageway 46 is formed at the first end of the casing 20. The piston rod 30 extends through this passageway and the casing includes an annular seal 48 which surrounds and seals against the piston rod 30.

A first radial chamber surface is formed where the passageway 46 and the cylinder section 40 meet.

A similar second radial chamber surface is formed where cylinder section 40 and cylinder section 42 meet. A third radial chamber surface is formed where cylinder section 42 meets cylinder section 44.

The movable piston 28 includes a plurality of piston sections corresponding in number to the cylinder sections. In the illustrated embodiment there are three movable piston sections and they are designated 50, 52 and 54. An outer radial piston surface is formed where the piston rod 30 connects to piston section 50. In similar fashion, an outer radial surface is formed where piston section 50 meets piston section 52. A third outer radial piston surface is formed where piston section 52 meets piston section 54.

The piston cavity and the fixed piston 36 are of a similar stepped construction. A radial chamber surface is formed where piston cavity section 56 meets piston cavity section 58. A similar radial chamber surface is formed where piston cavity section 58 meets piston cavity section 60. Fixed piston 36 includes an inner end surface 62. A radial piston surface is formed where first fixed piston section 64 meets second fixed piston section 66. A similar radial piston surface is formed where the second piston section 66 meets a third fixed piston section 68.

Fixed piston 36 includes a neck portion 70 immediately inwardly of the head 38 which snugly fits within the large diameter cylinder section 44. A radial chamber surface 72 is formed at the inner end of 70.

As shown, the movable piston sections 50, 53, 54 carry seal rings SR which seal against the sidewall surfaces of cylinders sections 40, 42, 44. In similar fashion, the sections 64, 66, 68, 70 of fixed piston 36 carry seal rings SR which seal against the sidewall surfaces of piston cavity sections 56, 58, 60 and chamber section 44, as shown.

The chamber formed between surfaces 34 and 62 is non-functional and is vented to the atmosphere. This may be done via a vent chamber 74, formed in the piston rod end of movable piston 28. Alternatively, the vent passageway could be formed in the fixed piston 36.

Paired equal piston area chambers which drive the unit in and out are identified by circled numbers 1, 2 and 3 on FIG. 2. In the preferred embodiment, the piston areas of chamber 1, 2 and 3 are related in the ratios of 1, 2 and 4.

The set of chambers 1, 2 and 3 which are located on the piston rod end of the actuator 188 (on the left in FIG. 2) are bounded axially by the radial casing cavity surfaces and the outer radial surfaces on the movable piston 196. The corresponding chambers 1, 2, 3 at the opposite end of the actuator 12 are bounded axially by the radial surfaces of the piston cavity and the radial surfaces of the fixed piston 36.

The actuator 12 can be operated as either a unidirectional or a bidirectional binary force producer by the proper selection of the type of control valves used to control its chamber pressures. The illustrated embodiment requires three on-off three-way poppet or spool valves 76, 78, 80 to produce seven levels of force output of a single directional sign. In the illustrated embodiment, all three working actuator chambers 1, 2, 3 on the piston rod side of the piston 28 are either vented or supplied from a constant pressure source. Supply pressure is applied selectively to one or more of the three opposing cylinder chambers 1', 2', 3', by operation of the three-way valves 76, 78, 80. Valves 76, 78, 80 may be positioned by solenoids 82, 84, 86, controlled by a suitable control device 88 which includes an input from an air speed sensor 90 and a control surface deflection sensor 92.

The actuator 12 could be used to produce seven steps of control force in either direction by the use of the system of three solenoid valves with each valve designed to produce the following output states.

| 1 Chambers (TYP.) | Right Chamber | Left Chamber |
|---|---|---|
| State 1 | 1 | 0 |
| State 2 | 0 | 1 |
| State 3 | 1 | 1 |
| Alternate State 3 | 0 | 0 |

The above valve output combinations could be produced by either six simple three-way poppet solenoid valves or by three double-poppet type solenoid valves. The design of the control system, including the control valves, is not considered a part of the present invention and for this reason the control system has only been schematically shown.

The design of the actuator 12 is not restricted to 7 steps of force output level. The number of actuator working chambers can be increased or decreased by changing the number of steps of the working piston to adjust the binary bit count of the actuator to any number within reason.

As previously mentioned, an equivalent hydromechanical system could be devised using a group of parallel fluid actuators having piston areas related as a binary sequence. However, the concentric array of actuator sections incorporated in actuator 12 is seen to be superior to the equivalent parallel system of actuators in each of the following respects.

1. The concentric unit is very compact with minimum parts count.
2. External leakage paths are kept to an absolute minimum in the concentric actuator array.
3. The control valves may be simple solenoid driven poppets or ball valves.
4. The control valves may be grouped on the actuator body minimizing plumbing complexity.
5. The output vectors of all actuator segments are colinear.

The outer end of piston rod 30 may comprise a mounting eye 94 which includes an opening 96 for receiving a pivot pin.

The control surface 10 is provided with apertured ear portions which receive the trunnions, to provide the trunnion axis 22. A recess may be formed in the leading edge portion of the control surface to provide space to accommodate the trunnion end of the casing 20. The specific manner of pivotally attaching the bungee 12 to the control surface can be done in many ways. The design of these details is not considered a part of the present invention.

Figure 3:
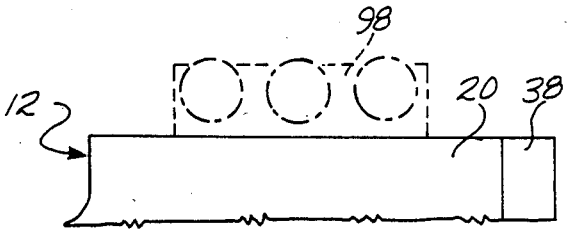
FIG. 3 is a fragmentary view showing a typical arrangement of control valves on the casing of the actuator, made possible by the unique construction of the actuator.

Supply pressure $P_s$ and return pressure $P_R$ passageways are shown to be formed in the casing and fixed piston portions of the actuator. These passageways may be formed in the conventional manner, by drilling intersecting passageways and plugging those portions of the drill holes which are not a part of the passageways. The unique construction of the actuator allows the outer ends of all of the passageways to be grouped together on one side of the casing 20, enabling a valve housing 98 to be mounted onto such side portion of the casing 20 as shown by FIG. 3.

The fluid supply and return system shown by FIG. 2 is the type of system that will adapt the actuator 12 for use as a counterbalancing bungee, in the manner that has been described both herein and in my copending application Ser. No. 536,040. As previously mentioned, a small servoactuator of a conventional type (not shown) is used in an active mode to position the surface 10.

The actuator 12 may be used in other installations and the supply and return of the operating fluid can be controlled in other ways. The particular valving arrangement that is shown is a part of the system invention disclosed and claimed in my copending application Ser. No. 536,040, but is not a part of the present invention.

The invention and its attendant advantages will be understood from the foregoing description and it will be apparent that various changes may be made in the form, construction, and the arrangement of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims.

What is claimed is:

1. A fluid actuator, comprising:

an elongated casing having a stepped diameter inner cavity;

a movable piston in said casing cavity, having a stepped diameter outer portion corresponding to the stepped diameter casing cavity, and a stepped diameter inner piston cavity;

a stepped diameter fixed piston corresponding to the stepped diameter inner piston cavity, received within said inner piston cavity;

said casing, said movable piston and said fixed piston cooperating to define a plurality of actuator sections, each comprising a variable volume working chamber which progressively increase in diameter from a first end of the actuator to a second end of the actuator, and said actuator including fluid passageways for delivering fluid to and from the variable volume chambers.

2. A fluid actuator according to claim 1, wherein the stepped diameter outer portion of the movable piston carries seal rings which seal against the stepped diameter inner cavity of the elongated casing and the stepped diameter fixed piston carries seal rings which seal against the stepped diameter inner piston cavity.

3. A fluid actuator according to claim 1, wherein the elongated casing has first and second ends, a small diameter opening in its first end, and a larger diameter opening in its second end in through which the movable and fixed pistons are inserted, wherein said movable piston includes first and second ends and a piston rod at its first end which extends through the opening in the first end of the elongated casing, and wherein the fixed piston includes first and second ends and a head at its second end which forms a closure for the access opening in the second end of the elongated casing.

4. A fluid actuator according to claim 3, wherein said fixed piston includes a neck portion immediately axially inwardly of said head portion and said neck portion is snugly received within the inner cavity of the elongated casing at the second end of the casing.

5. A fluid actuator according to claim 4, wherein the neck portion of the fixed piston carries a seal ring which seals against a mating inner surface portion of the inner cavity of the elongated casing.

6. A fluid actuator according to claim 1, wherein said fluid passageways are formed in wall portions of both the elongated casing and the fixed piston.

7. A fluid actuator according to claim 6, wherein the fluid passageways comprise a first set for delivering fluid to and from the variable volume chambers formed by and between the fixed piston and the stepped diameter inner piston cavity which have sections in both the fixed piston and a sidewall portion of the elongated casing.

8. A fluid actuator according to claim 7, wherein the sections of said first set of passageways which extend in the sidewall portion of the elongated casing have surface ports on said sidewall portion of the elongated casing, and wherein the fluid passageways further comprise a second set for delivering fluid to and from the variable volume chambers defined between the movable piston and the inner cavity in the elongated casing which extend through said sidewall portion of the elongated casing and have surface ports in close proximity to the surface ports for the first set of fluid passageways.

9. A variable force fluid actuator, comprising:

an elongated casing including a first end, a second end and an inner casing cavity, said casing cavity having an end opening at the second end of the casing;

a movable piston in said casing cavity having a first rod end, second opposite end, and an inner piston cavity said piston cavity having an end wall of its inner end and an end opening at said second end;

a fixed piston in said piston cavity having a first end and a second end;

said casing cavity having a plurality of cylinder sections which progressively increase in diameter from the first end of the casing to the second end of the casing, with radial surfaces being formed where the sections meet;

said casing including an axial passageway at its first end which is smaller in diameter than the first cylinder section, and a radial surface being formed where the passageway and the first cylinder section meet;

said movable piston including an elongated piston rod at its first end which projects through said axial passageway, and a plurality of movable piston sections corresponding in number and outside diameter to the cylinder sections, with outer radial surfaces being formed where the movable piston sections meet;

said piston rod connecting to a small diameter movable piston section, with an outer radial surface being formed where the piston rod and the small diameter movable piston section meet;

said piston cavity providing an axial series of increasing diameter cylindrical sections commencing with a small diameter section within the first movable piston section and ending with a large diameter section within the large diameter movable piston section, with inner radial surfaces being formed where the sections meet, with a central opening into said piston cavity being formed at the second end of the piston, and with an outer radial end surface being formed about said opening;

said fixed piston having a plurality of fixed piston sections corresponding in number and diameter to the sections of the piston cavity, with radial surfaces being formed where adjacent fixed piston sections meet;

said fixed piston including means connecting it to said casing, including means closing the end opening of the casing cavity and means forming a radial surface extending between a large fixed piston section at the second end of the fixed piston and a surrounding wall portion of a large cylinder section;

with each movable piston section having a fluid chamber formed at each of its ends, a rod end chamber and an opposite end chamber, with the rod end chamber being bounded axially by a radial outer surface on the movable piston and a radial surface on said casing, and with the opposite end chamber being bounded axially by a radial inner surface on the movable piston and a radial surface on the fixed piston;

with an end chamber being formed between the end wall of the piston cavity and the first end of the fixed piston;

means venting said end chamber; and a fluid passageway for each piston end chamber and each opposite end chamber, each passageway having a first end communicating with its chamber and a second end communicating with a port leading outwardly of the fluid actuator.

10. An actuator according to claim 9, wherein the fluid passageways for the rod end chambers are formed in the casing and the fluid passageways for the opposite end chambers are formed in the fixed piston.

11. An actuator system according to claim 9, wherein the means venting said end chamber comprises a passageway extending through the piston rod.

12. An actuator according to claim 9, wherein each movable piston section is formed to include at least one circumferential groove and an annular seal member is provided in said groove, for sealing between the movable piston section and the cylinder section sidewall and each fixed piston section includes at least one circumferential groove and a seal means within said groove for sealing between such fixed piston section and the inner piston cavity section in which it is received.

13. An actuator according to claim 9, wherein said means for connecting the fixed piston to the casing includes a head at the second end of the fixed piston including an end part having a radial face in contact with the second end of the casing and a plug part immediately inwardly of the end part having a diameter corresponding to the inside diameter of the cylinder section at the second end of the casing.

14. An actuator according to claim 13, wherein the radial surface extending between the large fixed piston section at the second end of the fixed piston and the surrounding wall portion of the large cylinder section is a surface portion of said plug part.

15. An actuator according to claim 13, wherein the plug part includes a radially outwardly directed circumferential groove and seal means in said groove sealing between such plug part and a surrounding wall portion of the large cylinder section at the second end of the casing.

16. An actuator according to claim 9, comprising three cylinder sections and three movable piston sections.

17. An actuator according to claim 16, comprising fluid pressure delivery means including a conduit for each rod end chamber and a valve in each such conduit operable for selectively connecting each rod end chamber to supply pressure or return pressure, whereby the actuator is capable of an output force level which is proportional to the sum of a group of weighted binary bits.

* * * * *

UNITED STATES PATENT AND TRADEMARK OFFICE
CERTIFICATE OF CORRECTION

PATENT NO. : 4,602,481

DATED : July 29, 1986

INVENTOR(S) : Curtiss W. Robinson

It is certified that error appears in the above-identified patent and that said Letters Patent are hereby corrected as shown below:

On the front page of the patent, left column, "[73] Assignee: The Boeing Company, Seattle, Wash." should be deleted.

Signed and Sealed this

Seventeenth Day of March, 1987

*Attest:*

*Attesting Officer*

DONALD J. QUIGG

*Commissioner of Patents and Trademarks*